US011628965B2

(12) United States Patent
Strauss et al.

(10) Patent No.: US 11,628,965 B2
(45) Date of Patent: Apr. 18, 2023

(54) LABELLING APPARATUS AND METHOD FOR APPLYING LABELS TO CONTAINERS

(71) Applicant: KRONES AG, Neutraubling (DE)

(72) Inventors: Johannes Strauss, Wolfsegg (DE); Christian Holzer, Schierling (DE); Bernd Schroll, Regensburg (DE)

(73) Assignee: KRONES AG, Neutraubling (DE)

( * ) Notice: Subject to any disclaimer, the term of this patent is extended or adjusted under 35 U.S.C. 154(b) by 452 days.

(21) Appl. No.: 16/472,847

(22) PCT Filed: Oct. 16, 2017

(86) PCT No.: PCT/EP2017/076285
§ 371 (c)(1),
(2) Date: Jun. 21, 2019

(87) PCT Pub. No.: WO2018/114077
PCT Pub. Date: Jun. 28, 2018

(65) Prior Publication Data

US 2019/0322403 A1 Oct. 24, 2019

(30) Foreign Application Priority Data

Dec. 23, 2016 (DE) ..... 10 2016 226 178.9

(51) Int. Cl.
*B65C 9/18* (2006.01)
*B65C 3/08* (2006.01)
(Continued)

(52) U.S. Cl.
CPC ..... *B65C 9/183* (2013.01); *B65C 3/08* (2013.01); *B65C 9/42* (2013.01); *B65H 20/34* (2013.01); *B65C 2009/0081* (2013.01)

(58) Field of Classification Search
CPC ... B65C 2009/0081; B65C 3/08; B65C 9/183; B65C 9/42; B65H 20/34
See application file for complete search history.

(56) References Cited

U.S. PATENT DOCUMENTS 6,585,844 B1 * 7/2003 Lochner ..... B31D 1/021 156/289
6,910,820 B2 * 6/2005 Baker ..... B41J 3/4075 156/384
(Continued)

FOREIGN PATENT DOCUMENTS

CN 203727772 U 7/2014
DE 3923163 A1 1/1991
(Continued)

OTHER PUBLICATIONS

Scheck et al., DE 102010037285, English machine translation of specification and original document (Year: 2010).*
(Continued)

*Primary Examiner* — Philip C Tucker
*Assistant Examiner* — Brian R Slawski
(74) *Attorney, Agent, or Firm* — McCoy Russell LLP

(57) ABSTRACT

A labeling device and a method for applying labels to containers comprising an unwinding unit for receiving thereon at least one supply roll with a label tape; having an intermediate buffer unit for temporarily storing the label tape unwound from the supply roll, the intermediate buffer unit comprising at least one first movable roller unit; a drive unit arranged downstream of the intermediate buffer unit when seen in the conveying direction and used for driving the label tape in the conveying direction and processing unit for separating the label tape into the individual labels and for optionally coating the labels with glue and for transferring the labels to the containers wherein the intermediate buffer unit and the drive unit have arranged between them a separately configured, dynamic buffer unit comprising at least one second roller unit which is movable independently of the intermediate buffer unit.

13 Claims, 4 Drawing Sheets

(51) Int. Cl.

| | |
|---|---|
| ***B65C 9/42*** | (2006.01) |
| ***B65H 20/34*** | (2006.01) |
| ***B65C 9/00*** | (2006.01) |

(56) References Cited

U.S. PATENT DOCUMENTS

| | | | | |
|---|---|---|---|---|
| 2009/0159193 | A1* | 6/2009 | Leykamm | B65C 9/105<br>156/256 |
| 2012/0067502 | A1* | 3/2012 | Piana | B65C 9/44<br>156/64 |

FOREIGN PATENT DOCUMENTS

| | | | |
|---|---|---|---|
| DE | 202005002793 | U1 | 4/2005 |
| DE | 102010037285 | A1 | 3/2012 |
| DE | 102012200826 | A1 | 7/2013 |
| DE | 202013105749 | U1 | 5/2014 |
| EP | 0414056 | A2 | 2/1991 |

OTHER PUBLICATIONS

Scheck et al., Device for using in labelling for conveying label strip . . . , Mar. 8, 2012, DE102010037285, English translation and original document (Year: 2012).*

ISA European Patent Office, International Search Report Issued in Application No. PCT/EP2017/076285, dated Feb. 7, 2018, WIPO, 4 pages.

China National Intellectual Property Administration, Office Action and Search Report Issued in Application No. 201780080154.8, dated Oct. 12, 2020, 19 pages (Submitted with Partial Translation).

* cited by examiner

LABELLING APPARATUS AND METHOD FOR APPLYING LABELS TO CONTAINERS

CROSS-REFERENCE TO RELATED APPLICATIONS

The present application is a U.S. National Phase of International Patent Application Serial No. PCT/EP2017/076285 entitled "LABELLING APPARATUS AND METHOD FOR APPLYING LABELS TO CONTAINERS," filed on Oct. 16, 2017. International Patent Application Serial No. PCT/EP2017/076285 claims priority to German Patent Application No. 10 2016 226 178.9 filed on Dec. 23, 2016. The entire contents of each of the above-referenced applications are hereby incorporated by reference for all purposes.

TECHNICAL FIELD

The present invention relates to a labeling device used for applying labels to containers, a labeling machine used for labeling containers and comprising a conveyor and a labeling device, a system comprising a labeling machine and a container manufacturing machine and/or a container treatment machine as well as to a method of applying labels to containers by means of a labeling device.

BACKGROUND AND SUMMARY

Usually, labeling machines comprising at least one labeling device are used for providing containers, such as cans, tubes, plastic or glass bottles, with labels identifying and/or advertising the content of the containers. Such labeling machines normally comprise a conveyor, which is preferably configured as a carousel and by means of which the containers are accommodated in container holders and moved past a labeling device. The labeling device comprises an unwinding unit for receiving thereon one or a plurality of supply rolls with a label tape, an intermediate buffer unit for buffering the label tape, a drive unit for driving the label tape and a processing unit. The processing unit is provided e.g. with a cutting unit by means of which the label tape is cut into individual labels, has glue applied thereto and is then transferred to the containers.

The intermediate buffer unit is normally used for compensating production fluctuations or for buffering the connection of label tapes of two supply rolls in a splicing device.

Such a labeling device is known e.g. from DE 20 2005 002793 U1 or from DE 3923163 A1.

Such labeling machines can be combined with a container manufacturing machine into a block so as to form a plant. For example, preforms are stretch-blow molded into finished containers by means of the container manufacturing machine and transferred to the labeling machine directly afterwards. The container manufacturing machine and the labeling machine work here with same cycle rate, so that the containers can be transferred between the two machines without any intermediate container buffer. However, an inspection is carried out after the stretch-blow molding process, so as to discharge damaged containers, e.g. in the case of bottle bursts. Likewise, an incorrect transfer may occur. This may result in gaps in the transfer of the containers to the labeling machine.

In addition, the containers in such a container manufacturing machine are produced only at operating speed as a result of the manufacturing process used. Hence, the downstream labeling machine must be started from a standstill to the labeling speed within a container interval.

It may therefore happen that the drive unit for the label tape must be started or stopped particularly quickly in order to either reach the labeling speed within a very short time or omit individual labels when a container is missing.

A drawback of the known labeling machines and labeling units is that, in the case of very high accelerations or decelerations of the drive unit, correspondingly high forces will act on the label tape. As a result, the label tape or the labels may be cut incorrectly, processed incorrectly, coated with glue incorrectly or even damaged. Moreover, malfunctions in the labeling machine and in the labeling device may be caused.

Therefore, it is the object of the present invention to provide a labeling machine, a labeling device and a method for labeling containers, which allow the drive for the label tape to be started and stopped quickly while ensuring correct processing of the label tape and of the labels, respectively.

For solving this posed task, the present invention provides a labeling device.

Comprehensive tests have shown that the intermediate buffer unit configured for the largest possible buffering of the label tape often fails to react fast enough to high accelerations of the label tape and that correct processing is not always guaranteed. Due to the fact that the labeling device comprises the separately configured, dynamic buffer unit between the intermediate buffer unit and the drive unit, high accelerations of the label tape through the drive unit will be buffered in a particularly effective manner. Since the second roller unit in the dynamic buffer unit is movable independently of the intermediate buffer unit, it can be configured for functioning as dynamically as possible. As a result, the dynamic buffer unit can react particularly fast to the high accelerations, so that reliable processing of the label tape and the labels, respectively, can be guaranteed.

The labeling device may be arranged in a beverage processing plant. The labeling device may be arranged downstream of a filling plant used for filling a product into the containers. Preferably, the labeling device may be arranged in a labeling machine. For example, the labeling device may be arranged at the circumference of a conveyor configured as a carousel. It is imaginable that the labeling device is connected to the labeling machine via a releasable connection. For example, the labeling device may be arranged, at least partially, on a separate, floor-supported carrier frame, which is adapted to be docked onto the labeling machine via at least one coupling element.

The containers may be provided for accommodating therein beverages, hygiene articles, pastes, chemical, biological and/or pharmaceutical products. The containers may be plastic bottles, glass bottles, tubes and/or cans.

The labels may be labels applied to the containers by means of an adhesive (such as glue). The labels may be cut to size from paper or plastic comprising in particular an imprint, which identifies, describes and/or advertises the content of the containers. The label tape may comprise a plurality of concatenated labels, the processing unit being configured for cutting the label tape into individual labels making use of a cutting device.

The unwinding unit may be configured to comprise at least one roll holder for receiving thereon the at least one supply roll and for unwinding the latter. The unwinding unit may comprise a splicing device for connecting two label tapes of two different supply rolls.

The first movable roller unit of the intermediate buffer unit may comprise two or even more than two deflection rollers. The intermediate buffer unit may comprise the first movable roller unit and a fixed roller unit with two or even more than two deflection rollers. It is also imaginable that the intermediate buffer unit comprises, in addition to the first movable roller unit, a further movable roller unit with two or even more than two deflection rollers. The label tape may be guided around the deflection rollers of the intermediate buffer unit in at least one loop. The first movable roller unit may be configured to comprise a preferably spring-tensioned movement mechanism for moving it relative to the fixed roller unit. Likewise, it is imaginable that the first movable roller unit is actively driven by a drive for moving it relative to the fixed roller unit. As a result, the length of the loops around the deflection rollers will be changed, so that the label tape will be received by or removed from the intermediate buffer unit. Preferably, the deflection rollers of the intermediate buffer unit may be arranged along a straight line. The first movable roller unit may be pretensioned by a first spring element so as to tension the loops of the label tape.

The labeling device may comprise a running control unit for adjusting a position of the label tape relative to the drive unit and/or the processing unit. To his end, the running control unit may comprise at least one deflection roller whose position is adjustable transversely to the label tape.

The drive unit may comprise at least one drive roller for driving the label tape in the conveying direction. For example, the drive unit may comprise two rollers, at least one of which is driven, the label tape being guided between the two rollers. The drive unit may comprise an electric motor as a drive for providing the driving force for the drive roller.

The processing unit may comprise a cutting unit for cutting the label tape into individual labels. It is also imaginable that the processing unit comprises one or a plurality of vacuum cylinders for conveying the label tape or individual labels. By way of example, the processing unit may comprise a vacuum cylinder for moving the individual labels past a gluing unit and for transferring them to the containers. The gluing unit may be configured to provide the labels, which are preferably attached to the vacuum cylinder, with hot or cold glue.

The dynamic buffer unit may comprise, in addition to the second movable roller unit, a fixed roller unit with at least one deflection roller, the movable roller unit and the fixed roller unit being arranged relative to one another such that the label tape is guided in at least one loop through the roller units. The roller units may comprise deflection rollers for guiding the label tape. For example, the dynamic buffer unit may comprise two fixed deflection rollers, between which the label tape is guided in a loop around a deflection roller of the second movable roller unit. The at least one loop can be increased or reduced in size by the movement of the second movable roller unit.

The second movable roller unit may comprise a movement mechanism for a deflection roller, the movement mechanism and the deflection roller being configured such that, when the labeling device is started within a container interval, a dynamic pulling force acting on the label tape will be limited to 50 N or less. This will ensure a reliable processing of the label tape. The movement mechanism may comprise a second spring element for controlling the pulling force in the label tape. Likewise, the movement mechanism may comprise a drive, e.g. a servo motor, for actively controlling the pulling force in the label tape. "Starting the labeling device within a container interval" may here mean that the processing unit of the labeling device is started from a standstill to a labeling speed within said one container interval. "Container interval" may here mean a periodic period of time elapsing between the labeling of two successive containers during trouble-free operation. Likewise, a labeling machine may be configured to comprise a conveyor for conveying the containers in container holders and to further comprise the labeling device, the container holders being arranged in a regularly spaced mode on the conveyor, and "container interval" may here mean the respective period of time elapsing between two successive container holders that move past the labeling device. The dynamic pulling force may, at least partially, originate from an inertia of the movement mechanism and/or of the deflection roller. Additionally or alternatively, the dynamic pulling force may originate from a spring-tensioned condition of the movement mechanism.

The labeling device may comprise deflection rollers for guiding the label tape. Preferably, the deflection rollers may have a diameter in a range of 0-25 mm, optionally in a range of 0-20 mm, further optionally in a range of 16-18 mm. In particular, at least one of the deflection rollers may be arranged in the dynamic buffer unit. Due to the small diameter, the moments of inertia of the deflection rollers are particularly low and the tensions caused by the inertial forces that are applied through the deflection rollers to the label tape are less strong. It follows that, in the case of high accelerations, the label tape will be subjected to particularly little stress and, consequently, protected against damage. The deflection rollers referred to hereinbefore or hereinafter may, at least partially, have the diameter in a range of 0-25 mm, optionally in a range of 0-20 mm, further optionally in a range of 16-18 mm. The deflection rollers may be driven passively by the label tape. However, actively driven deflection rollers are imaginable as well. Preferably, at least one deflection roller of this type may be arranged in the dynamic buffer unit. In this way, the label tape can be moved even more dynamically in the dynamic buffer unit.

The dynamic buffer unit may be arranged directly upstream of the drive unit, when seen in the conveying direction. As a result, the inert mass of the conveyor belt and the moments of inertia of the deflection rollers between the drive unit and the dynamic buffer unit will be particularly small.

The second movable roller unit may have a lower mass than the first movable roller unit. This makes the dynamic buffer unit more dynamic than the intermediate buffer unit, so as to compensate respective forces occurring in the label tape in the case of high accelerations. Preferably, the second movable roller unit may comprise less deflection rollers than the first movable roller unit, optionally precisely one deflection roller.

The second movable roller unit may be pretensioned with a second spring element. This makes it particularly easy to control the pulling force in the label tape. The second spring element may be a tension spring or a compression spring. The dynamic buffer unit may comprise a damping element so as to dampen the movement of the second movable roller unit. Vibrations between the dynamic buffer unit and the intermediate buffer unit can be dampened or avoided in this way. The second spring element and/or the damping element may be coupled to the second movable roller unit. For example, the second spring element and/or the damping element may be arranged between the second movable roller unit and a fixed point on the carrier frame of the labeling device.

The second movable roller unit may comprise at least one pivotable or movable deflection roller. This leads to a particularly simple structural design of the dynamic buffer unit.

For example, the second movable roller unit may comprise as a movement mechanism an optionally spring-tensioned pivot lever, so as to pivot the deflection roller about an axis. The pivot lever may e.g. be pivotably supported via a hinge at one end thereof and may be connected to the deflection roller at the other end thereof. Alternatively, the second movable roller unit may comprise as a movement mechanism a pivot lever, which is actively driven by a drive, so as to pivot the deflection roller about an axis.

It is also imaginable that the second movable roller unit comprises as a movement mechanism a carriage, which is movable and/or optionally spring-tensioned by means of a spring element, so as to move the deflection roller along an optionally linear path. As a result, the mass of the carriage is particularly low, so that the dynamic buffer unit will have a particularly low mass inertia. The linear path may comprise a guide rail with which the spring-tensioned carriage is movably supported. Alternatively, the movement mechanism may comprise a drive for moving the carriage.

The dynamic buffer unit may e.g. comprise two fixed deflection rollers, between which the label tape is guided in a loop around the deflection roller, which is movable by means of the pivot lever or by means of the movable carriage. In this way, the loop between the two fixed deflection rollers and the movable deflection roller is formed. It follows that the dynamic buffer unit has a particularly compact structural design.

The unwinding unit and the intermediate buffer unit may be configured as a separate unit with a carrier frame which is separate from the processing unit. This allows the unwinding unit and the intermediate buffer unit to be flexibly arranged in the plant. It is imaginable that the separate unit comprises the unwinding unit with a plurality of supply rolls, a splicing unit and/or the intermediate buffer unit, so as to form the substantially endless label tape by means of these units. In addition, at least one guide roller may be provided for guiding the label tape from the separate unit to a labeling unit comprising the dynamic buffer unit, the drive unit and the processing unit.

Alternatively, it is imaginable that the unwinding unit, the intermediate buffer unit, the dynamic buffer unit, the drive unit and the processing unit are integrally configured as a labeling unit. In other words, the labeling device may be configured as a labeling unit.

In addition, the present invention provides a labeling device with the features of claim 12 for solving the posed task.

Due to the diameter in the range of 0-25 mm, the moments of inertia of the deflection rollers are particularly low, whereby the inertial forces acting on the label tape through the deflection rollers are reduced and result in less strong tensions in the tape. It follows that, during high accelerations, the label tape will be subjected to particularly little stress and will therefore be protected against damage. The deflection rollers may be driven passively by the label tape.

Furthermore, the labeling device may comprise the above described features individually or in arbitrary combinations.

In addition, the present invention provides a labeling machine for labeling containers for solving the posed task.

The label tape will be subjected to particularly little stress during high accelerations and, consequently, it will not be damaged when the label feed is started and stopped quickly.

The conveyor may preferably be configured as a carousel having container holders arranged thereon for conveying the containers. The container holders may comprise a rotary table and a centering bell for accommodating the container base and the container mouth of the containers. The rotary table may be driven by a drive, e.g. a control cam or a servo motor. The containers can thus be rotated when the labels are being transferred, so that the labels can reliably be applied to the curved outer surface of the containers.

The labeling machine may comprise a control unit for controlling the labeling device and the conveyor during the labeling process.

In addition, the present invention provides a system comprising a labeling machine and a container manufacturing machine and/or a container treatment machine, the labeling machine following the container manufacturing machine or the container treatment machine directly, without intermediate buffering of the containers, and being combined therewith into a block thus forming a plant.

Due to the fact that the labeling machine comprises the labeling device with the dynamic buffer unit, the label tape can be started or stopped particularly quickly within a container interval, the pulling forces in the label tape being limited through the dynamic buffer unit. This will guarantee correct processing of the label tape and of the labels, respectively.

The container manufacturing machine may be, or may comprise a stretch-blow molding machine, which is configured to form preforms into finished containers by stretch-blow molding. "Following the . . . directly, without intermediate buffering of the containers, . . . combined therewith into a block" may here mean that the containers are produced by the container manufacturing machine with a cycle rate corresponding to that with which the containers are subsequently labeled by the labeling machine, without any buffering of the containers between the container manufacturing machine and the labeling machine taking place. In this way, the plant can be provided with a particularly compact and cost-efficient structural design.

The container manufacturing machine may e.g. be, or comprise a recycling machine, a rinser or the like. For example, a rinser may be arranged downstream of the container manufacturing machine, the labeling machine following the rinser directly, without intermediate buffering of the containers, and being combined therewith into a block.

Furthermore, the present invention provides the method having the features of claim 15 for solving the posed task. Advantageous embodiments are specified in the subclaims.

Due to the fact that the label tape is buffered between the intermediate buffer unit and the drive unit by the separately configured, dynamic buffer unit with a roller unit that is movable independently of the intermediate buffer unit, high accelerations of the label tape through the drive unit are limited in a particularly effective manner. Since the second roller unit in the dynamic buffer unit is movable independently of the intermediate buffer unit, it can be configured for functioning as dynamically as possible. As a result, the dynamic buffer unit can react particularly fast to the high accelerations, so that reliable processing of the label tape and the labels, respectively, can be guaranteed.

Preferably, the containers may be conveyed in container holders of a conveyor of a labeling machine at fixed intervals. During starting, the label tape is accelerated by the drive unit from a standstill to a labeling speed and, in this process, it is removed at least partially from the dynamic buffer unit, so that a pulling force occurring in the label tape during acceleration will be limited, preferably to less than 50 N. As a result, the label tape will not be not taken from the more inert intermediate buffer unit, but from the dynamic buffer unit. Therefore, the lower inertial forces of the dynamic buffer unit will act on the label tape, the dynamic buffer unit being configured for functioning as dynamically as possible. The limitation to a pulling force of less than 50 N will prevent high stresses on the label tape.

The containers may be conveyed in container holders of a conveyor of a labeling machine at fixed intervals, the label tape being buffered in the dynamic buffer unit in the case of an empty container holder, so as to interrupt the application of labels for the empty container holder. If a gap occurs in the container flow, e.g. due to a faulty container, the transfer of the respective label can be stopped temporarily and then started again making use of this method, so that any malfunction will be excluded.

Preferably, the containers may be produced by means of a system according to claim 14 and labeled directly afterwards, without intermediate container buffering.

BRIEF DESCRIPTION OF THE FIGURES

Further features and advantages of the present invention will be explained hereinafter in more detail with reference to the embodiments shown in the figures, in which.

DETAILED DESCRIPTION

Figure 1:
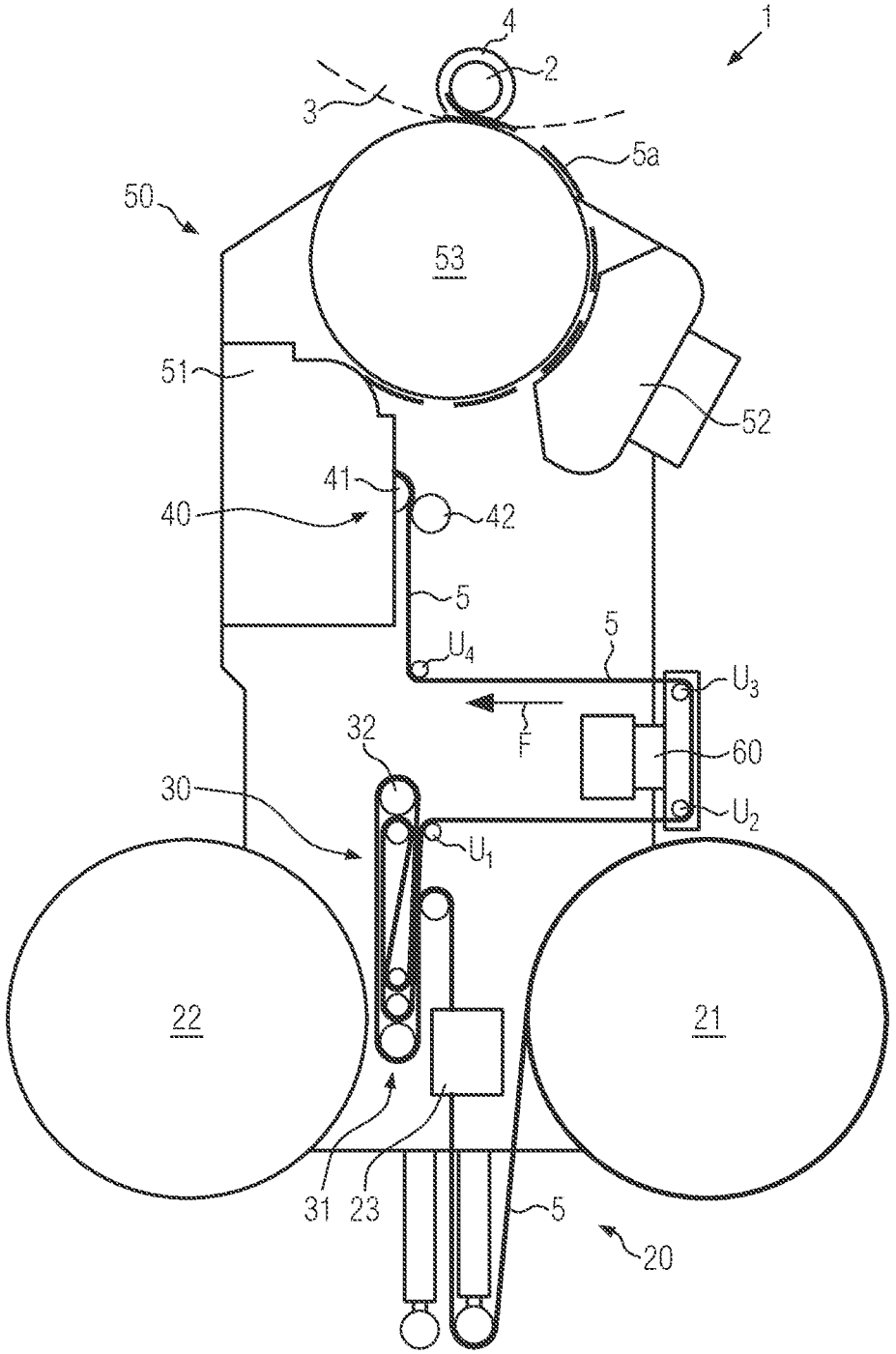
FIG. 1 shows, in a top view, an embodiment of a labeling device with deflection rollers having a diameter in a range of 0-25 mm.

FIG. 1 shows, in a top view, an embodiment of a labeling device 1 with deflection rollers $U_1$, $U_2$, $_U$3, $U_4$ having a diameter in a range of 0-25 mm. What can be seen is the labeling device 1 by means of which the label tape 5 is processed into individual labels 5*a*, which are then transferred to the containers 2. In addition, it can be seen that, during labeling, the containers 2 are accommodated in rotatable container holders 4 of the conveyor 3 and moved past the labeling device 1. The containers 2 can here be rotated during transfer of the labels 5*a* so that they can be labeled all around or over only part of their circumference.

The labeling device 1 itself comprises an unwinding unit 20 for receiving thereon the two supply rolls 21 and 22. In FIG. 1, the label tape 5 is being unwound from the supply roll 21. When its end has been reached, it is connected to the beginning of the label tape of the supply roll 22 by means of the splicing unit 23. This will ensure interruption-free operation.

In addition, the intermediate buffer unit 30 comprising the fixed roller unit 31 and the movable roller unit 32 can be seen. The roller units 31, 32 each comprise a plurality of deflection rollers of different sizes around which the label tape 5 is guided in several loops. In order to accommodate a larger amount of label tape 5 in the intermediate buffer unit 30, the movable roller unit 32 can be moved away from the fixed roller unit 31 by means of a spring element, which is not shown here. This will increase the loop length accordingly. In order to remove the label tape 5 from the intermediate buffer unit 30, the movement will take place the other way round, so that the loop length will be reduced. This has the effect that, when the label tapes 5 of the supply rolls 21, 22 are interconnected by means of the splicing unit 23, the time required for this process will be bridged.

What can additionally be seen is the running control unit 60 for adjusting the exact position of the label tape 5 relative to the downstream drive unit 40 and the processing unit 50.

For driving the label tape 5, the intermediate buffer unit 30 is followed by the drive unit 40, when seen in the conveying direction F. The latter comprises the drive rollers 41, 42, at least one of which is driven by a drive, which is not shown here, preferably by a servo motor. Between the two drive rollers 41, 42, the label tape 5 is fixed such that the driving force will be transmitted to the label tape 5. It follows that the label tape 5 is drawn by means of the drive unit 40, so that it will be drawn from the supply roll 21, through the splicing unit 23, through the intermediate buffer unit 30 across the running control unit 60 to the deflection roller $U_4$.

Subsequently, the label tape 5 is supplied to the processing unit 50. Here, it will first be separated into individual labels 5*a* by a cutting unit 51, the labels being then moved past the gluing station 52 by means of the vacuum cylinder 53 and coated with glue in the course of this process. Following this, the labels 5*a* are transferred to the containers 2 in the container holders 4.

The deflection rollers $U_1$, $U_2$, $U_3$, $U_4$ have a diameter of 17 mm in the present example. However, also any other suitable diameter in a range of 0-25 mm is imaginable. Due to the low moment of inertia of the deflection rollers $U_1$, $U_2$, $U_3$, $U_4$ the resultant inertial forces applied to the label tape 5 will be particularly low, so that the label tape will be subjected to as little tension as possible during acceleration. As a result, the label tape 5 is subjected to less stress during high accelerations and is protected against damage in this way.

Figure 2:
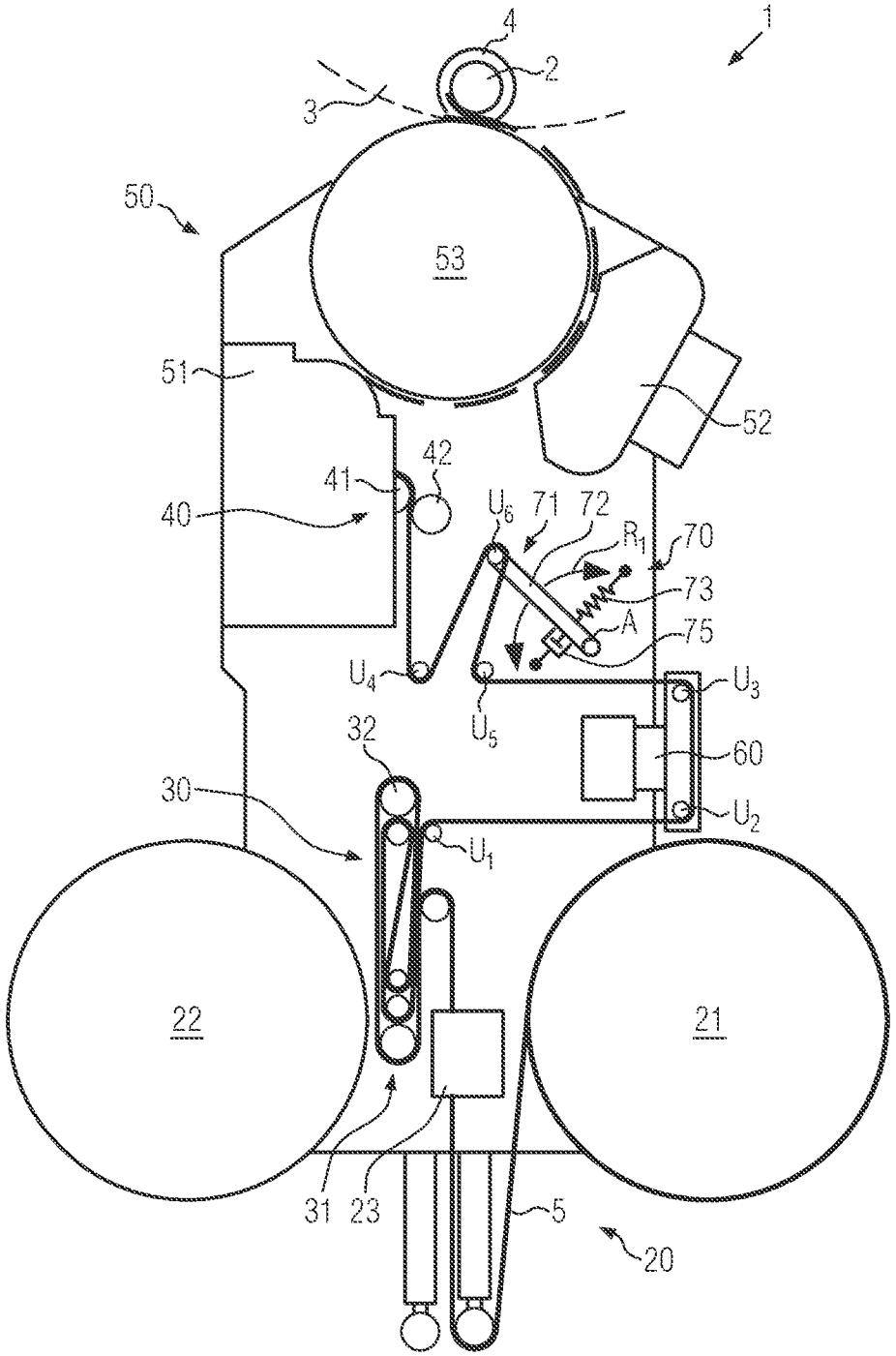
FIG. 2 shows a further embodiment of a labeling device with a dynamic buffer unit, which comprises a pivot lever having a deflection roller arranged thereon.

FIG. 2 shows a further embodiment of a labeling device 1 with a dynamic buffer unit 70, which comprises a pivot lever 72 having a deflection roller $U_6$ arranged thereon. The embodiment in FIG. 2 differs from that in FIG. 1 only insofar as the intermediate buffer unit 30 and the drive unit 40 have arranged between them the separately configured, dynamic buffer unit 70 with the independently movable roller unit 71. The features described above with respect to FIG. 1, apply to FIG. 2 accordingly.

The dynamic buffer unit 70 comprises the two fixedly arranged deflection rollers $U_4$, $U_5$ as well as the movable roller unit 71 with the deflection roller $U_6$. What can be seen is that the movable deflection roller $U_6$ is arranged on the pivot lever 72 so that it can be pivoted about the axis A in the direction $R_1$. By means of the deflection rollers $U_4$, $U_5$, $U_6$, a loop of the label tape 5 is formed, which can be increased or reduced in size through a movement of the pivot lever 72. In addition, the pivot lever 72 is pretensioned by the spring element 73, so that the loop will be subjected to permanent tension. As a result, the dynamic buffer unit 70 operates passively in accordance with the belt length demanded by the drive unit 40.

Due to the fact that the second movable roller unit 71 only comprises said one deflection roller $U_6$, it also has a lower mass than the first movable roller unit 32 in the intermediate buffer unit 30. This allows the dynamic buffer unit 70 to work with a significantly lower mass inertia than the intermediate buffer unit 30, where the movable roller unit 32 comprises three deflection rollers. As a result, the dynamic buffer unit is particularly effective during especially high accelerations of the label tape 5 and buffers the resultant tensions particularly well.

In addition, the damping element 75 can be seen, which dampens the movement of the pivot lever 72 and of the second movable roller unit 71, respectively. In this way, vibrations between the dynamic buffer unit 70 and the intermediate buffer unit 30 will be avoided, which may otherwise have a negative effect on the conveying behavior of the label tape 5.

Furthermore, the dynamic buffer unit 70 and the intermediate buffer unit 30 are configured such that the first movable roller unit 32 is pretensioned by a first spring element, which is here not shown, and the second movable roller unit 71 is pretensioned by the second spring element 73.

In addition, the deflection rollers $U_4$, $U_5$ of the dynamic buffer unit 70 have a diameter of 17 mm, but other suitable diameters in a range of 0-25 mm are imaginable as well. As a result, the inertial forces of the deflection rollers $U_4$, $U_5$ are particularly low.

Figure 3:
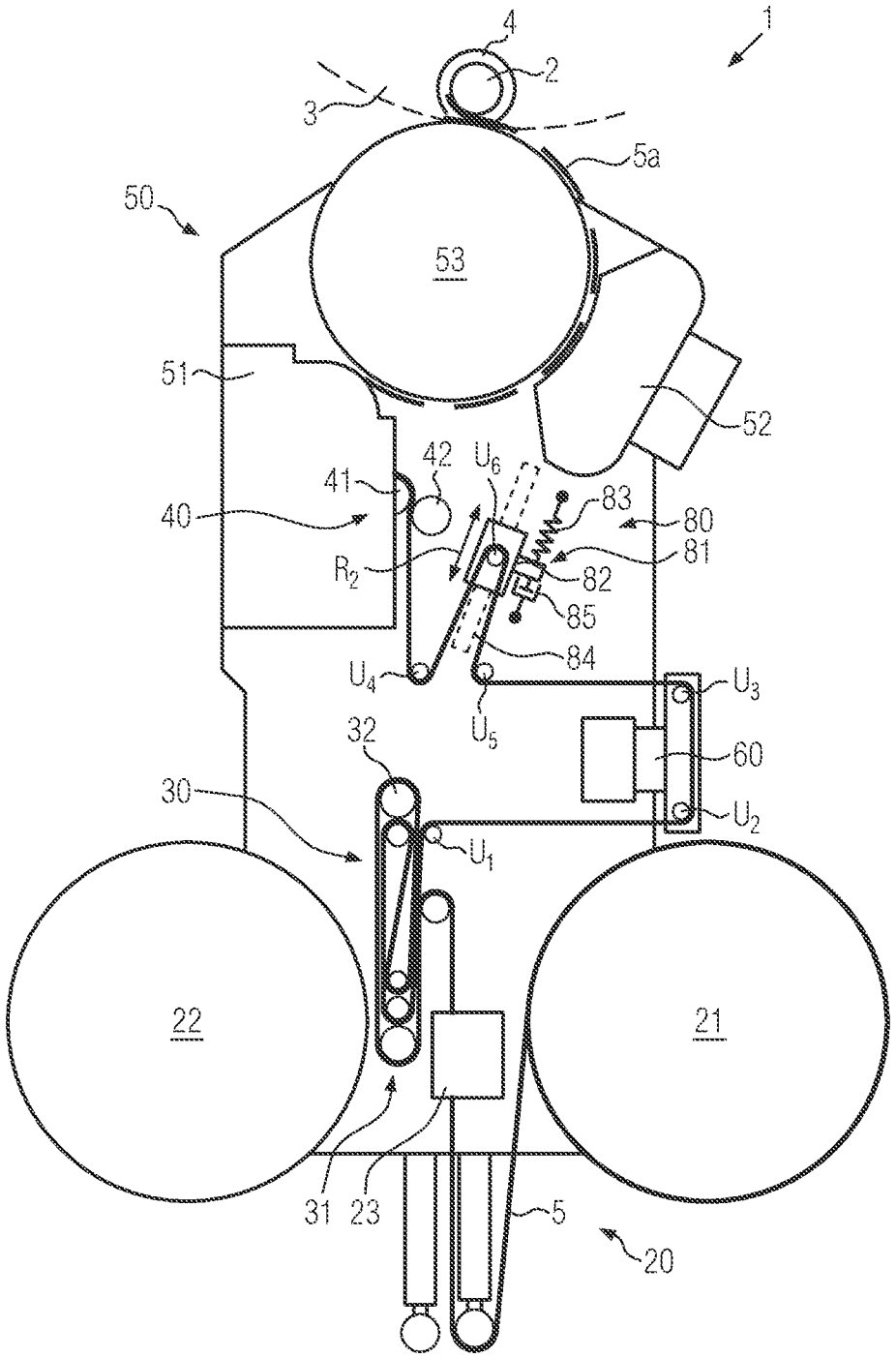
FIG. 3 shows a further embodiment of a labeling device with a dynamic buffer unit, which comprises a movable carriage having a deflection roller arranged thereon.

FIG. 3 shows a further embodiment of a labeling device 1 with a dynamic buffer unit 80, which comprises a movable carriage 82 having a deflection roller $U_6$ arranged thereon. The embodiment in FIG. 3 differs from that in FIG. 2 only with respect to the movement mechanism used for the second roller unit 81 and configured here as a movable and spring-tensioned carriage 82. Hence, corresponding features of FIGS. 1 and 2 also apply to FIG. 3.

What can be seen is that the fixed deflection rollers $U_{4\text{-}5}$ are here arranged in a way similar to FIG. 2. However, the deflection roller $U_6$ of the second movable roller unit 81 is arranged on a carriage 82, which is movable on guide rails along the direction $R_2$ in a linear path. In this way, the label tape 5 can be buffered dynamically. In addition, the spring 83 can be seen, by means of which the carriage 82 is pulled away from the fixed deflection rollers $U_4$, $U_5$. Similar to FIG. 2, the loop of the label tape 5 around the deflection rollers $U_4$, $U_5$ is held under tension in this way, so that the label tape 5 will be guided reliably.

What can be seen in addition is the damping element 85 for dampening the movement of the second movable roller unit 81. In this way, vibrations between the dynamic buffer unit 80 and the intermediate buffer unit 30 are dampened and/or suppressed.

Due to the fact that, in the above embodiments of FIG. 1-3, the deflection rollers $U_1$, $U_2$, $U_3$, $U_4$, $U_5$, $U_6$ have a diameter of 17 mm and 0-25 mm, respectively, the stress on the label tape 5 caused by the occurring inertial forces of the rollers $U_1$, $U_2$, $U_3$, $U_4$, $U_5$, $U_6$ will be particularly low. In addition, the dynamic buffer units 70, 80 shown in FIGS. 2 and 3 will buffer high accelerations when the label tape 5 is driven. Since the dynamic buffer units 70, 80 are arranged directly upstream of the drive unit 40, when seen in the conveying direction F, the tensions occurring in the label tape 5 due to the inertial forces will be particularly low. It follows that the label tape 5 can be started and stopped in a particularly gentle manner by the labeling devices 1 of FIG. 1-3, without being damaged. In addition, the labeling devices 1 in FIG. 1-3 can be operated in a particularly dynamic manner, so that the label tape 5 can also be started and stopped between two containers 2 within an operating cycle.

Figure 4:
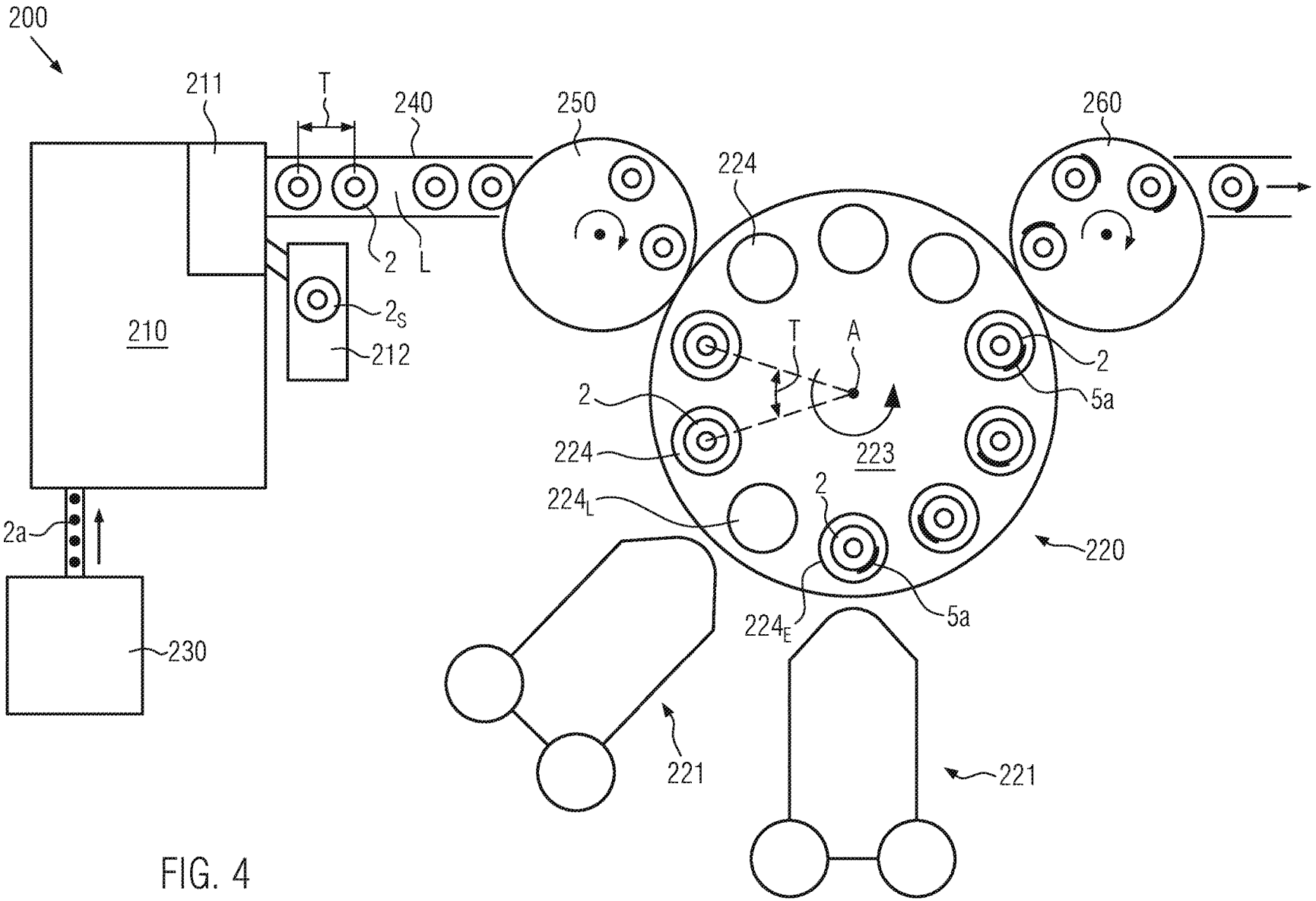
FIG. 4 shows, in a top view, an embodiment for a system comprising a container manufacturing machine and a labeling machine.

FIG. 4 shows, in a top view, an embodiment for a system 200 comprising a container manufacturing machine 210 and a labeling machine 220.

What can be seen is that the container manufacturing machine 210 obtains the preforms 2*a* from the supply 230 and forms them into finished containers 2 by means of a stretch-blow molding process. In this process, the preforms 2*a* are, in a manner known per se, preheated in a continuous furnace and placed into stretch blow molds. There, they are formed into finished containers 2 by stretching by means of a stretching mandrel and by inflation by means of a blow pin.

In addition, the container manufacturing machine 210 comprises at its outlet an inspection device 211, by means of which faulty containers 2*s* can be sorted out towards an ejection unit 212. As a result, the gap L is formed in the container flow, which remains empty during the subsequent labeling with the labeling machine 220, since intermediate container buffering does not take place.

Since the stretch-blow molding process depends on the temperature of the preforms 2*a*, among other factors, and consequently on the time which the preforms 2*a* need for passing through the continuous furnace, the containers 2 can only be produced at a constant operating speed. Hence, the containers 2 leave the container manufacturing machine 210 at the constant operating speed and at the intervals T. This circumstance applies in a corresponding manner also when the container manufacturing machine 210 is started. It follows that, when the container manufacturing machine 210 is started, the container flow shown will immediately be generated at the constant operating speed and with the intervals T without any smooth speed transition. Therefore, a compensation of the gap L on the part of the container manufacturing machine 210 will not be possible.

In addition, it can be seen that the containers 2 are transferred via the conveyor 240 and the infeed starwheel 250 to the conveyor 223 of the labeling machine 220. The conveyor 223 is here configured e.g. as a carousel rotating about the axis A and provided with circumferentially arranged container holders 224. Making use of the conveyor 223 of the labeling machine 220, the containers 2 are conveyed in the container holders 224 at fixed intervals T. The conveyor 223 is additionally synchronized with the container manufacturing machine 210, with the intervals T corresponding to one another. It follows that the containers 2 are processed by the labeling machine 220 with a cycle rate corresponding to that with which they are manufactured in the container manufacturing machine 210. Therefore, the gap L cannot be compensated for by the labeling machine 220 either.

At the conveyor 223, the containers 2 are received in the container holders 224 and conveyed past the labeling devices 221. The labeling devices 221 correspond optionally to the labeling devices 1 described above with respect to FIG. 1-3, preferably according to the embodiments of FIG. 2 or 3.

Making use of the labeling devices 221, the labels 5*a* are applied to the containers 2. Labeling can be seen exemplarily from the container holder $\mathbf{224}_E$, where the label 5*a* is just being transferred to the container 2. Subsequently, the containers 2 are conveyed by means of the conveyor 223 to the discharge starwheel 260 and advanced so as to undergo further treatment steps.

What can additionally be seen is that, due to a gap in the container flow, the container holder $\mathbf{224}_L$ is empty. In order to prevent a malfunction of the labeling machine 220, the labeling device 221 associated with this container holder $\mathbf{224}_L$ will interrupt the application of the labels 5*a* for a short period of time. During this period, the label tape 5 is stored temporarily in the dynamic buffer unit 70, 80 (corresponding to FIGS. 2 and 3) and then fed again at the subsequent container holder 224 for labeling the container 2 contained in the latter and for thus continuing labeling after the interruption.

In addition, the label tape 5 is accelerated from a standstill to the labeling speed when the drive unit 40 is started and, in this process, it is removed at least partially from the dynamic buffer unit 70, 80. The dynamic buffer unit 70, 80 is here configured such that, during acceleration, the resultant pulling force in the label tape 5 is limited to less than 50 N.

Since the inertial forces acting on the label tape 5 are particularly low due to the dynamic buffer unit 70, 80, the pulling force is limited accordingly. It follows that, due to processing by the labeling devices 221, the label tape 5 is guided and processed in a particularly reliable manner during starting and/or during an interruption of the labeling process.

It goes without saying that features referred to in the above-mentioned embodiments are not limited to these special combinations and may also be used in any other combination.

The invention claimed is:

1. A labeling device for applying labels to containers, comprising:

an unwinding unit for receiving thereon at least one supply roll with a label tape;

an intermediate buffer unit for temporarily storing the label tape unwound from the supply roll, the intermediate buffer unit comprising at least one first movable roller unit;

a drive unit comprising at least one drive roller and an electromotor as a drive for providing a driving force for the drive roller, whereby the drive unit is arranged downstream of the intermediate buffer unit when seen in a conveying direction and used for driving the label tape in the conveying direction; and a processing unit for separating the label tape into the individual labels, wherein the intermediate buffer unit and the drive unit have arranged between them a separately configured, dynamic buffer unit comprising at least one second movable roller unit, which is movable independently of the intermediate buffer unit, and wherein the second movable roller unit comprises a movement mechanism for a deflection roller, the movement mechanism and the deflection roller being configured such that, when the labeling device is started within a container interval, a dynamic pulling force acting on the label tape will be limited to 50 N or less.

2. The labeling device according to claim 1, wherein the labeling device comprises deflection rollers for guiding the label tape having a diameter in a range of 0-25 mm.

3. The labeling device according to claim 2, wherein at least one of the deflection rollers is arranged in the dynamic buffer unit.

4. The labeling device according to claim 1, wherein the dynamic buffer unit is arranged directly upstream of the drive unit, when seen in the conveying direction.

5. The labeling device according to claim 1, wherein the second movable roller unit has a lower mass than the first movable roller unit.

6. The labeling device according to claim 1, wherein the second movable roller unit comprises fewer deflection rollers than the first movable roller unit.

7. The labeling device according to claim 1, wherein the second movable roller unit is pretensioned with a second spring element and/or wherein the dynamic buffer unit comprises a damping element so as to dampen the movement of the second movable roller unit.

8. The labeling device according to claim 1, wherein the second movable roller unit comprises at least one pivotable or movable deflection roller.

9. The labeling device according to claim 8, wherein the second movable roller unit comprises as a movement mechanism a pivot lever, so as to pivot the deflection roller about an axis.

10. The labeling device of claim 9, wherein the pivot lever is a spring-tensioned pivot lever.

11. The labeling device according to claim 8, wherein the second movable roller unit comprises as a movement mechanism a movable and/or spring-tensioned carriage, so as to move the deflection roller along an optionally linear path.

12. The labeling device according to claim 1, wherein the unwinding unit and the intermediate buffer unit are configured as a separate unit with a carrier frame which is separate from the processing unit.

13. The labeling device according to claim 1, wherein the processing unit coats the labels with glue and transfers the labels to the containers.

* * * * *